US011460798B2

(12) United States Patent
Tsuruta

(10) Patent No.: US 11,460,798 B2
(45) Date of Patent: Oct. 4, 2022

(54) STORED OBJECT DETECTION APPARATUS, IMAGE FORMING APPARATUS, AND STORED OBJECT DETECTION METHOD

(71) Applicant: SHARP KABUSHIKI KAISHA, Sakai (JP)

(72) Inventor: Kentaro Tsuruta, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/334,330

(22) Filed: May 28, 2021

(65) Prior Publication Data

US 2021/0389714 A1 Dec. 16, 2021

(30) Foreign Application Priority Data

Jun. 10, 2020 (JP) ..... JP2020-101054

(51) Int. Cl.
*G03G 21/12* (2006.01)

(52) U.S. Cl.
CPC ..... *G03G 21/12* (2013.01)

(58) Field of Classification Search
CPC ..... G03G 21/12
See application file for complete search history.

(56) References Cited

U.S. PATENT DOCUMENTS 4,761,674 A * 8/1988 Ogura ..... G03G 21/12 399/35
2017/0356787 A1* 12/2017 Welle ..... G01V 8/005
2019/0107425 A1* 4/2019 Welle ..... G01S 13/88
2019/0390997 A1* 12/2019 Blomberg ..... G01S 7/352

FOREIGN PATENT DOCUMENTS

DE 102016013940 A1 * 5/2017
DE 102019113599 B3 * 10/2020
JP S64-030418 U 2/1989
JP 2016006457 A 1/2016

* cited by examiner

*Primary Examiner* — Walter L Lindsay, Jr.
*Assistant Examiner* — Milton Gonzalez
(74) *Attorney, Agent, or Firm* — ScienBiziP, P.C.

(57) ABSTRACT

A stored object detection device includes: a radar sensor which emits a radio wave and detects a reflected wave; a reflector which reflects the radio wave emitted from the radar sensor; and a detection target object storage amount detector which detects a storage amount of a detection target object in a container, based on a reflected wave of the radio wave that has been reflected on the container containing the detection target object, a reflected wave of the radio wave that has passed through the container and has been reflected on the detection target object, and a reflected wave of the radio wave that has passed through the container and has been reflected on the reflector.

9 Claims, 6 Drawing Sheets

| | | | | | | | |
|---|---|---|---|---|---|---|---|
| AMOUNT OF WASTE TONER | LESS | ↔ | | | | ↔ | MORE |
| | THICK LINE | < | LINE WITH CIRCLES | < | LINE WITH SQUARES | < | LINE WITH TRIANGLES |
| | WASTE TONER EMPTY | ↔ | | | | ↔ | WASTE TONER FULL |
| REFLECTION INTENSITY | 10 | > | 8 | > | 6 | > | 4 |

STORED OBJECT DETECTION APPARATUS, IMAGE FORMING APPARATUS, AND STORED OBJECT DETECTION METHOD

CROSS-REFERENCE TO RELATED APPLICATION

The present application claims priority from Japanese Patent Application Number 2020-101054, the content to which is hereby incorporated by reference into this application.

BACKGROUND OF THE INVENTION

Field of the Invention

The present invention relates to a stored object detection device or the like, and more particularly to a stored object detection device or the like that detects a stored object in the storage by a radar sensor.

Description of the Background Art

Conventionally, electrophotographic image forming apparatuses such as copiers, printers, and facsimiles are known. In the apparatuses, residual toner after printing which is generated in an image former is removed and recovered as waste toner in a waste toner recovery container.

As a conventional technology, for example, it has been disclosed that in an image forming apparatus, the remaining amount of toner is detected by measuring the height of the toner surface in a toner box (container) where the toner is stored (see Japanese Unexamined Patent Application Publication 2016-6457).

In Japanese Unexamined Patent Application Publication 2016-6457, when measuring the height of the toner surface, it is measured by the transmission and the reflected wave from the ultrasonic sensor provided thereon directly inside the toner box.

Further, as another conventional technology, in order to detect the remaining amount of kerosene in the tank, the liquid level of kerosene in the tank is detected by an ultrasonic sensor from the side surface outside the tank. (Japanese Unexamined Utility Model Application Publication No. 64-30418).

In Japanese Unexamined Utility Model Application Publication No. 64-30418, the transmitter and the receiver of the ultrasonic sensor are arranged so as to face the side surface outside the tank.

Normally, the waste toner recovery container is disposed after recovery of the waste toner. In Japanese Unexamined Patent Application Publication 2016-6457, an ultrasonic sensor is provided in the toner box to detect the remaining amount of toner in the toner box. Therefore, when this technology is used for the waste toner recovery container, a problem is that a disposable ultrasonic sensor, a power supply, a wiring connector, and the like are required for each waste toner recovery container.

Further, in order to detect waste toner from the outside of the waste toner recovery container by the ultrasonic sensor based on the technique of Japanese Unexamined Utility Model Application Publication No. 64-30418, the ultrasonic sensor needs to be tightly adhered onto the side surface of the waste toner recovery container, to accurately detect the waste toner.

For this reason, when the replaceable waste toner recovery container is used, it is necessary to bring the ultrasonic sensor adhered to the container every time the waste toner recovery container is replaced. This results in a problem of making the replacement work complicated, and may undesirably cause a problem that erroneous detection occurs without accurate detection, if the adhesion state is insufficient.

An aspect of the present invention has been made in view of the above-mentioned conventional problems, and it is accordingly an object of the aspect of the present invention to provide a stored object detection device or the like which can detect a stored object in a container and can prevent occurrence of erroneous detection with a simple configuration, without disposing a detection sensor or the like.

SUMMARY OF THE INVENTION

According to an aspect of the present invention, there is provided a stored object detection device comprising: a radar sensor which emits a radio wave and detects a reflected wave; a reflector which reflects the radio wave emitted from the radar sensor; and a detection target object storage amount detector which detects a storage amount of a detection target object in a container, based on a reflected wave of the radio wave that has been emitted from the radar sensor and reflected on the container containing the detection target object, a reflected wave that has passed through the container and has been reflected on the detection target object, and a reflected wave that has passed through the container and has been reflected on the reflector.

According to an aspect of the present invention, there is provided an image forming apparatus which forms an image by an electrophotographic method using toner, wherein a detection target object storage amount detection device is used as a waste toner detection device which detects waste toner in a container containing recovered waste toner. The detection target object storage amount detection device includes: a radar sensor which emits a radio wave and detects a reflected wave; a reflector which reflects the radio wave emitted from the radar sensor; and a detection target object storage amount detector (for example, waste toner detector) which detects a storage amount of a detection target object in a container, based on a reflected wave of the radio wave that has been reflected on the container (for example, a waste toner recovery container) containing the detection target object (for example, waste toner), a reflected wave of the radio wave that has passed through the container and has been reflected on the detection target object, and a reflected wave of the radio wave that has passed through the container and has been reflected on the reflector.

According to an aspect of the present invention, there is provided a stored object detection method comprising: emitting a radio wave from a radar sensor; detecting a reflected wave of the radio wave which has been reflected on a container containing a detection target object; detecting a reflected wave of the radio wave which has been reflected on the detection target object in the container; detecting a reflected wave of the radio wave which has passed through the container and has been reflected on a reflector; and detecting a storage amount of the detection target object in the container, based on a reflected wave which has been reflected on the container, a reflected wave which has been reflected on the detection target object in the container, and a reflected wave which has passed through the container and has been reflected on the reflector.

According to the stored object detection device or the like of the aspect of the present invention, since a detection target object in the storage is detected by using the radar sensor, the detection target object in the storage can be detected without touching the storage by the radar sensor. Therefore, it is possible to realize a stored object detection device or the like that can accurately detect a detection target object in the storage and that prevents occurrence of erroneous detection with a simple configuration, without disposing the detection sensor or the like.

DESCRIPTION OF THE PREFERRED EMBODIMENTS

First Embodiment

A first embodiment of the present invention will hereinafter be described with reference to the drawings.

Figure 1:
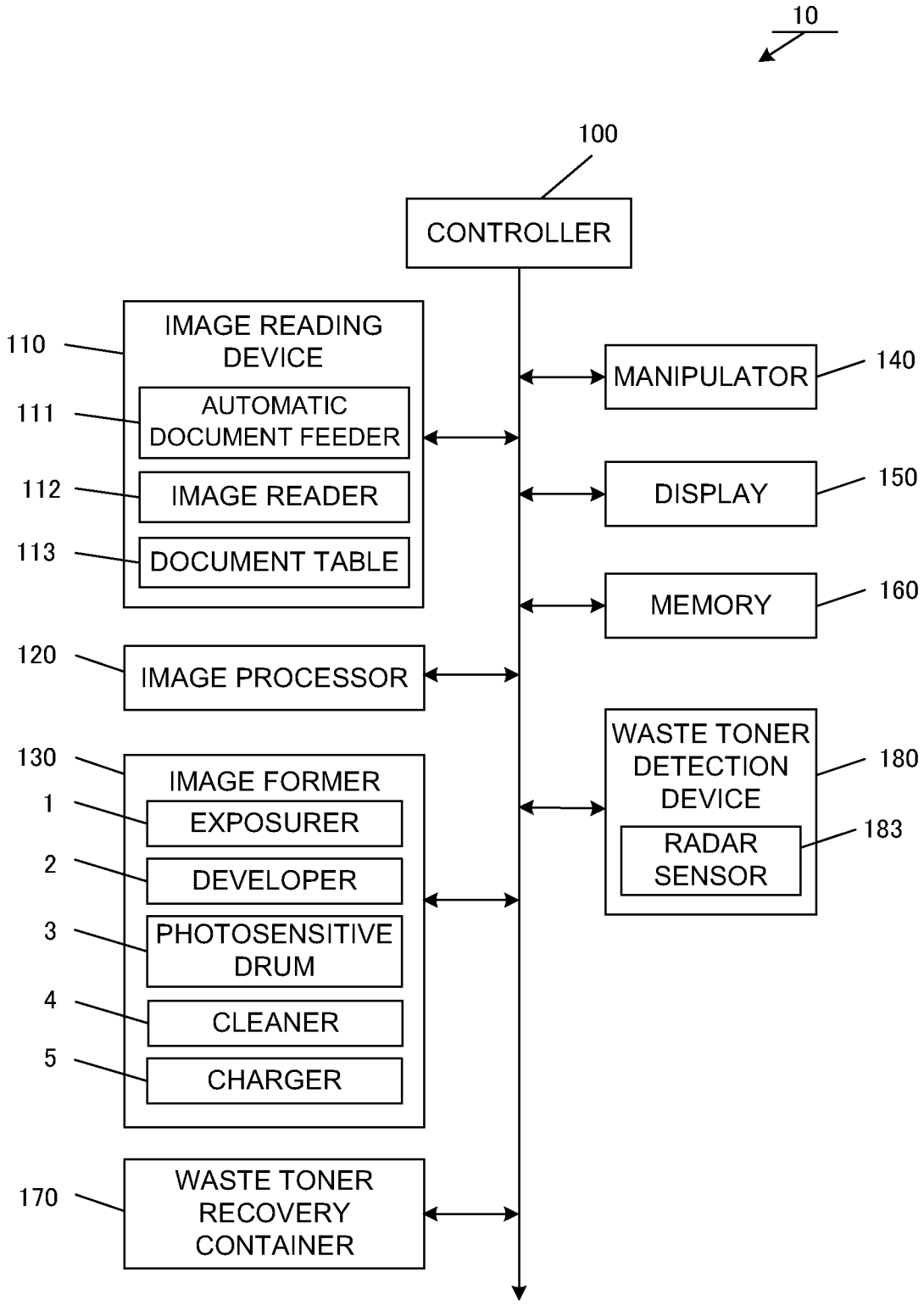
FIG. 1 is a block diagram illustrating a configuration of an image forming apparatus including a waste toner detection device according to the first embodiment.
Figure 2:
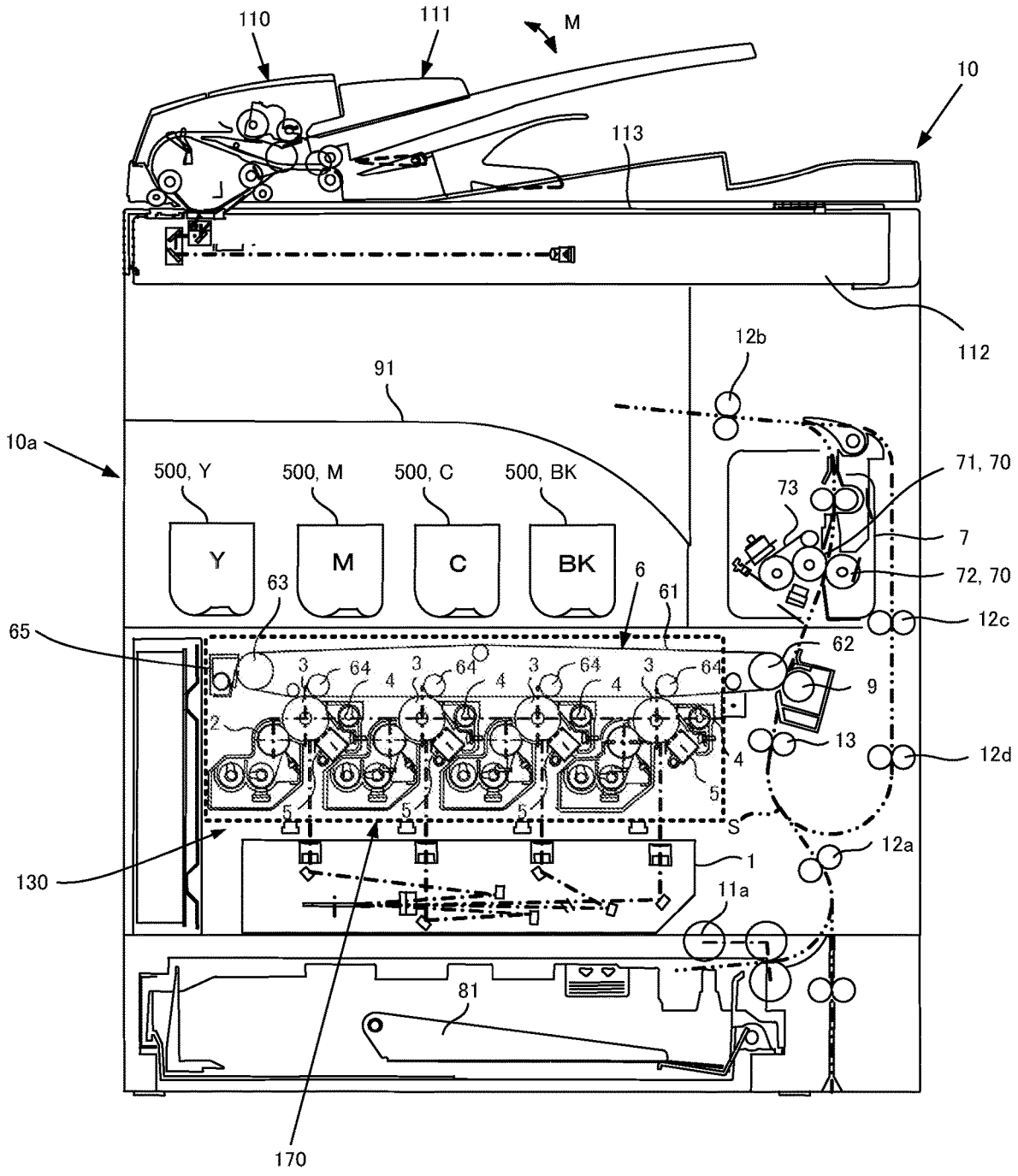
FIG. 2 is an explanatory diagram illustrating an overall configuration of an image forming apparatus.

FIG. 1 is an explanatory diagram which is an example of an embodiment of the present invention, that is, FIG. 1 is a block diagram showing a configuration of an image forming apparatus including a waste toner detection device according to the first embodiment of the present invention. FIG. 2 is an explanatory diagram which shows an overall configuration of the image forming apparatus.

In the first embodiment, as shown in FIG. 1, an image forming apparatus 10 that forms an image by an electrophotographic method using toner includes a waste toner detection device (stored object detection device) 180. This device 180 detects waste toner (detection target object) in a waste toner recovery container (storage) 170 containing the recovered waste toner.

The waste toner detection device 180 detects the waste toner recovered in the waste toner recovery container 170 by using a radar sensor 183.

Overall Configuration of Image Forming Apparatus

The basic configuration of the image forming apparatus 10 according to the first embodiment will now be described. As shown in FIG. 2, the image forming apparatus 10 is an information processing apparatus provided with an image reading device 110 on the upper portion of an apparatus main body 10*a* to read an image of the original document and to output an image by an electrophotographic method.

As shown in FIG. 1, the image forming apparatus 10 mainly includes a controller 100, an image reading device 110, an image processor 120, an image former 130, a manipulator 140, a display 150, and a memory 160.

The controller 100 is a functional unit for controlling the entire of the image forming apparatus 10.

The controller 100 realizes various functions by reading and executing various programs, and is configured with, for example, one or more arithmetic devices (for example, CPU (Central Processing Unit)) or the like.

The image reading device 110 mainly includes an automatic document feeder 111, an image reader 112, and a document table 113.

The automatic document feeder 111 is a functional unit that automatically feeds a plurality of original documents.

The image reader 112 is a functional unit for reading image data input to the image forming apparatus 10 from an original document.

The image processor 120 is a functional unit that performs various image processes onto image data. Then, the image processor 120 forms an output image based on the image data onto which an image process has been performed.

The image former 130 is a functional unit for forming output data based on the image data on a recording medium (for example, recording paper). For example, as shown in FIG. 2, the recording paper is fed from a paper supply cassette 81. After the image is formed on the surface of the recording paper in the image former 130, the paper is discharged to a paper discharge tray 91.

The manipulator 140 is a functional unit for receiving an operation instruction by the user, and is configured with various key switches, a device, etc. for detecting an input by contact. The user uses the operation processor 140, to input a function to be used and an output condition. The display 150 is a functional unit for displaying various information to the user, and is configured with, for example, an LCD (Liquid Crystal Display) or the like.

The image forming apparatus 10 may include a touch panel in which the manipulator 140 and the display 150 are integrally formed. In this case, a method of detecting an input on the touch panel may be a general detection method, such as a resistive method, an infrared method, an electromagnetic induction method, and an electrostatic capacitive method.

The memory 160 is a functional unit for storing various programs and various data necessary for the operation of the image forming apparatus 10. The memory 160 includes, for example, an SSD (Solid State Drive) as a semiconductor memory, and an HDD (Hard Disk Drive), etc.

Configuration of Each Unit of Device Body

The configuration of the apparatus main body 10*a* of the image forming apparatus 10 will be now described with reference to the drawings.

As shown in FIG. 2, the apparatus main body 10*a* mainly includes an exposurer 1, a developer 2, a photosensitive drum 3, a cleaner 4, a charger 5, a transferer 6, a fixer 7, the paper supply cassette 81, the paper discharge tray 91, etc.

The document table 113 made of transparent glass on which a document is placed is provided on the upper side of the image reader 112 provided on the upper portion of the apparatus main body 10*a*. The automatic document feeder 111 is mounted on the upper side of the document table 113.

The automatic document feeder 111 automatically feeds an original document onto the document table 113. In addition, the automatic document feeder 111 is configured to be rotatable in the direction of an arrow M, and the original document can be placed by hand by opening the top of the document table 113.

The image data handled in the image forming apparatus 10 corresponds to a color image using each color of black (BK), cyan (C), magenta (M), and yellow (Y). Therefore, four each of the developers 2, the photosensitive drums 3, the chargers 5, and the cleaners 4 are provided so as to form four types of latent images according to the respective colors. In particular, the set colors are black, cyan, magenta, and yellow, respectively. As a result, four image stations are formed.

The charger 5 is a charging means for uniformly charging the surface of the photosensitive drum 3 to a predetermined potential.

The exposurer 1 is an image writing device that forms an electrostatic latent image corresponding to image data on the surface of the photosensitive drum 3, by exposing the charged photosensitive drum 3 according to the image data input from the outside or the image data obtained by reading the original document.

The developer 2 is to develop the electrostatic latent image formed on each of the photosensitive drums 3 with four color toners of black (BK), cyan (C), magenta (M), and yellow (Y).

The four color toners of black (BK), cyan (C), magenta (M), and yellow (Y) are supplied to the developer 2 from toner cartridges 500 (BK), 500 (C), 500 (M), and 500 (Y) in which the respective toners are stored.

The toner cartridges 500 (BK), 500 (C), 500 (M), and 500 (Y) are stored above the image former 130 of the apparatus main body 10*a*.

The photosensitive drum 3 has a cylindrical shape, and is arranged above the exposurer 1. The surface thereof is cleaned by the cleaner 4, and the cleaned surface is uniformly charged by the charger 5.

The cleaner 4 removes and recovers toner (hereinafter, referred to as "residual toner") remaining on the surface of the photosensitive drum 3 after development and image transfer.

The transferer 6 arranged above the photosensitive drum 3 includes an endless intermediate transfer belt (endless belt) 61, an intermediate transfer belt driving roller 62, an intermediate transfer belt driven roller 63, intermediate transfer rollers 64, and an intermediate transfer belt cleaner 65. Four intermediate transfer rollers 64 are provided corresponding to the respective colors of Y, M, C, and BK.

The intermediate transfer belt driving roller 62, the intermediate transfer belt driven roller 63, and the intermediate transfer rollers 64 are configured to be rotatively driven by stretching the intermediate transfer belt 61.

The toner image developed according to each hue on each photosensitive drum 3 is laminated on the intermediate transfer belt 61. The toner image as the laminated image information is fed together with the intermediate transfer belt 61, is moved to the contact position (secondary transfer position, predetermined position) between the fed paper and the intermediate transfer belt 61, and is transferred onto the paper by the transfer roller 9 arranged in the contact position.

It is configured to remove and recover, by the intermediate transfer belt cleaner 65, the toner adhered to the intermediate transfer belt 61 or the toner (residual toner) remaining on the intermediate transfer belt 61 without being transferred onto the paper by the transfer roller 9. This is because the toner causes toner color mixing in the toner image to be formed in the subsequent step.

The residual toner removed by the intermediate transfer belt cleaner 65 and the cleaner 4 is recovered in a waste toner recovery container 170 provided inside a cover (not shown) on the front surface of the apparatus main body 10*a*.

The paper supply cassette 81 is a tray for storing paper for use in image formation, and provided on the lower side of the exposurer 1 of the apparatus main body 10*a*. Above the apparatus main body 10*a*, the paper discharge tray 91 for accumulating printed paper face-down is provided.

Further, the apparatus main body 10*a* is provided with an approximately vertical paper feeding path S for sending the paper of the paper supply cassette 81 to the paper discharge tray 91 via the transfer roller 9, the fixer 7, and the like. A pickup roller 11*a*, a plurality of feeding rollers 12*a* to 12*d*, a resist roller 13, the transfer roller 9, the fixer 7, and the like are arranged in the vicinity of the paper feeding path S from the paper supply cassette 81 to the paper discharge tray 91.

The feeding rollers 12*a* to 12*d* are small rollers for promoting and assisting the feeding of paper, and are provided along the paper feeding path S. Note that the feeding roller 12*b* is referred to as a paper discharge roller because it functions as a paper discharge roller for discharging paper to the paper discharge tray 91.

The pickup roller 11*a* is provided near the end of the paper supply cassette 81, picks up the paper one by one from the paper supply cassette 81, and supplies the paper to the paper feeding path S.

The resist roller 13 temporarily holds the paper being fed in the paper feeding path S. It has a function of feeding the paper to the transfer roller 9 at the timing of aligning the tip of the toner image on the photosensitive drum 3 with the tip of the paper.

The fixer 7 includes a pair of a heat roller 71 and a pressure roller 72 as the fixing rollers 70. The heat roller 71 and the pressure roller 72 rotate and feed the paper by holding the paper between them.

The heat roller 71 and the pressure roller 72 are arranged so as to face each other. A fixing nip is formed at a pressure contact point between the heat roller 71 and the pressure roller 72.

Together with the pressure roller 72, the heat roller 71 thermocompression-bonds the toner to the paper, thereby to melt, mix, and press-weld the multicolor toner image transferred to the paper, and to thermally fix the toner image to the paper.

Further, the heat roller 71 is provided with an external fixing belt 73 for fixing the heat roller 71 from the outside.

Configuration of Waste Toner Detection Device

Next, a characteristic configuration of the waste toner detection device 180 according to the first embodiment will be described.

Figure 3:
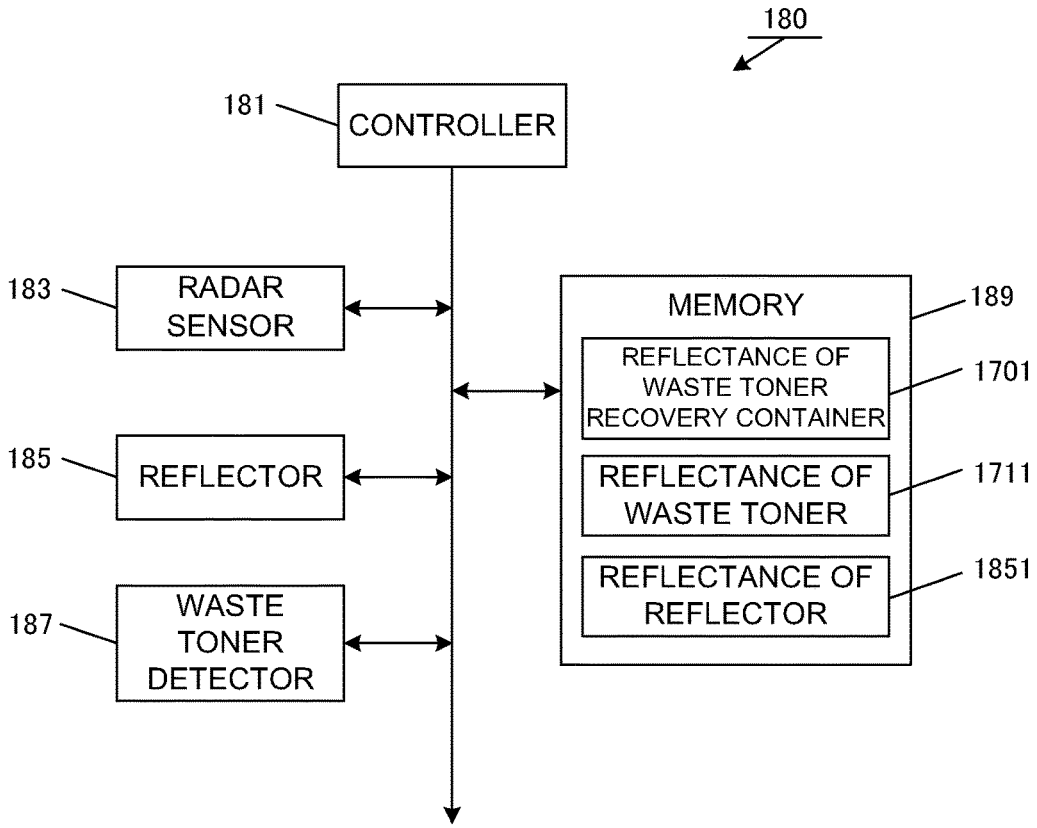
FIG. 3 is a block diagram illustrating a configuration of a waste toner detection device.
Figure 4:
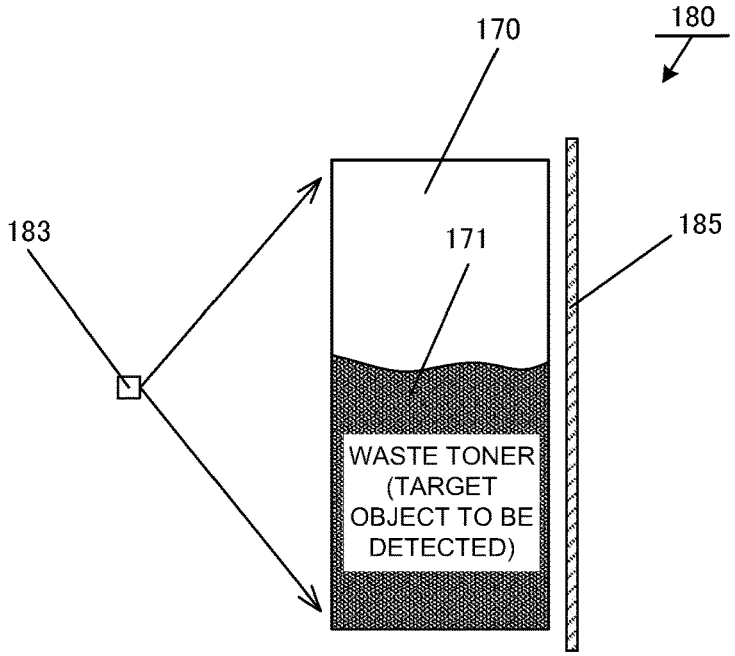
FIG. 4 is an explanatory diagram illustrating a schematic configuration of a waste toner detection device.

FIG. 3 is a block diagram showing the configuration of the waste toner detection device according to the first embodiment. FIG. 4 is an explanatory diagram showing a schematic configuration of the waste toner detection device.

As shown in FIG. 3, the waste toner detection device 180 is configured with a controller 181, a radar sensor 183, a reflector 185, a waste toner detector (detection target object storage amount detector) 187, and a memory 189.

The controller 181 controls detection of waste toner 171 in the waste toner recovery container 170 by the radar sensor 183.

The radar sensor 183 emits radio waves (radar wave) to detect a reflected wave.

In the first embodiment, the radar sensor 183 uses a pulse coherent radar sensor (hereinafter, referred to as "PCR sensor") as the radar sensor.

The PCR sensor detects energy of a generated pulse that has returned to a receiving antenna after being reflected from an object. The amount of energy depends on the reflectance of the object. The reflectance has a relationship that depends on a relative difference in permittivity between two catalysts that propagate the signal. The difference of the permittivity is used to discriminate the material.

This discrimination is performed by a reflected wave, that detects an object and is reflected at each boundary with a change in permittivity behind the surface of the object, in accordance with the pulse frequency. For example, it means that the object can be detected through a plastic housing.

Further, the PCR sensor is not sensitive to ambient light, sound, and color, and has high robustness. Therefore, the discrimination of the object by the PCR sensor is stably performed.

In the first embodiment, as shown in FIG. 4, the radar sensor 183 is arranged to face the reflector 185 via the waste toner recovery container 170. A pulse coherent radar is used as the radar sensor 183. This pulse coherent radar has a function of identifying materials and distinguishing between different materials, and utilizes the difference in boundary reflection accompanied by a change in the dielectric constant peculiar to the materials. The radar sensor 183, the waste toner recovery container 170, and the reflector 185 are arranged separately from each other.

Figure 5:
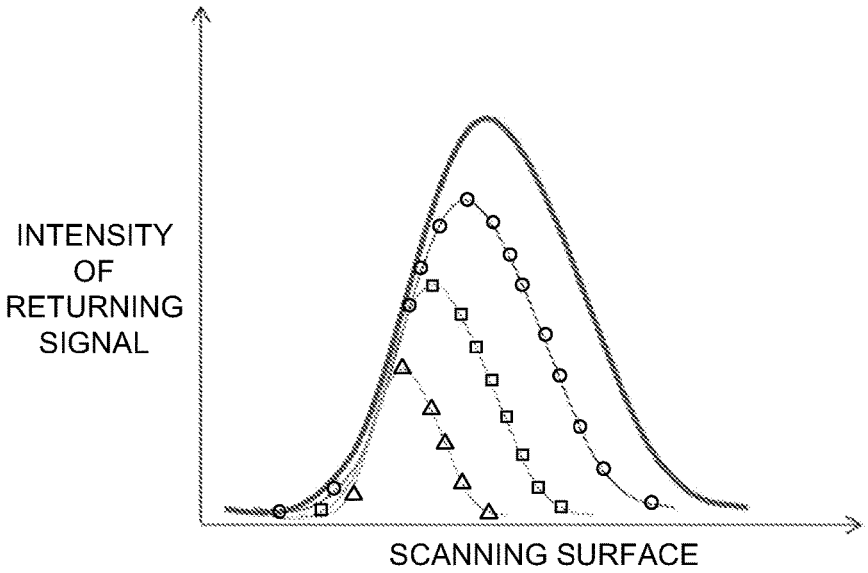
FIG. 5 is an explanatory diagram illustrating an example of detecting waste toner in a waste toner detector.

FIG. 5 shows an image example representing the detection signal of the radar sensor 183 received by the waste toner detector 187. The wave angle of the signal intensity changes from a case where an amount of waste toner is small as represented by a thick line to a case where an amount of waste toner is large as represented by a line with triangles. Based on this change, the amount of waste toner can be detected. In the signal intensity curve, the intensity of the returning signal that corresponds to the height and area is imaged rather than the position of the top of the wave peak.

The waste toner recovery container 170 is formed of a material having reflectance lower than that of the waste toner 171.

The reflector 185 reflects the radio waves emitted from the radar sensor 183. In the first embodiment, the reflector 185 is formed of a metal material.

The reflectance of the reflector 185 is set higher than the reflectance of the waste toner recovery container 170.

The memory 189 stores the relationship between the amount of waste toner in the waste toner recovery container 170 and the intensity of the received radar (total of the intensity and the area). Specifically, the memory 189 stores a reflectance of waste toner recovery container 1701, a reflectance of waste toner 1171 and a reflectance of reflector 1851.

The waste toner detector 187 determines the amount of the waste toner 171 to be stored in the waste toner recovery container 170, based on the intensity of the received radar of the radar sensor 183 and the relationship stored in the memory 189.

Specifically, in the first embodiment, the waste toner detector 187 determines the storage amount of the waste toner 171 contained in the waste toner recovery container 170, based on the relationship between the detection intensity of the radar sensor 183 and the amount of waste toner stored in the memory 189 and the intensity of the intensity of the received radar.

The waste toner detector 187 can detect waste toner as follows, based on the reflection intensity (reflectance) detected by the radar sensor as exemplified in FIG. 5.

If the waste toner is an object with high reflectance, and if the waste toner recovery container is an object with high reflectance, it is expected that it is difficult to distinguish between the waste toner and the plate toner recovery container.

Therefore, it is possible to improve the detection accuracy, since the difference in the reflectance of the waste toner becomes clear by forming the waste toner recovery container with a material having low reflectance.

About Waste Toner Detection Processing

Descriptions will now be made to a process for detecting the waste toner 171 in the waste toner recovery container 170 by the waste toner detection device 180 according to the first embodiment, along the flowchart.

Figure 6:
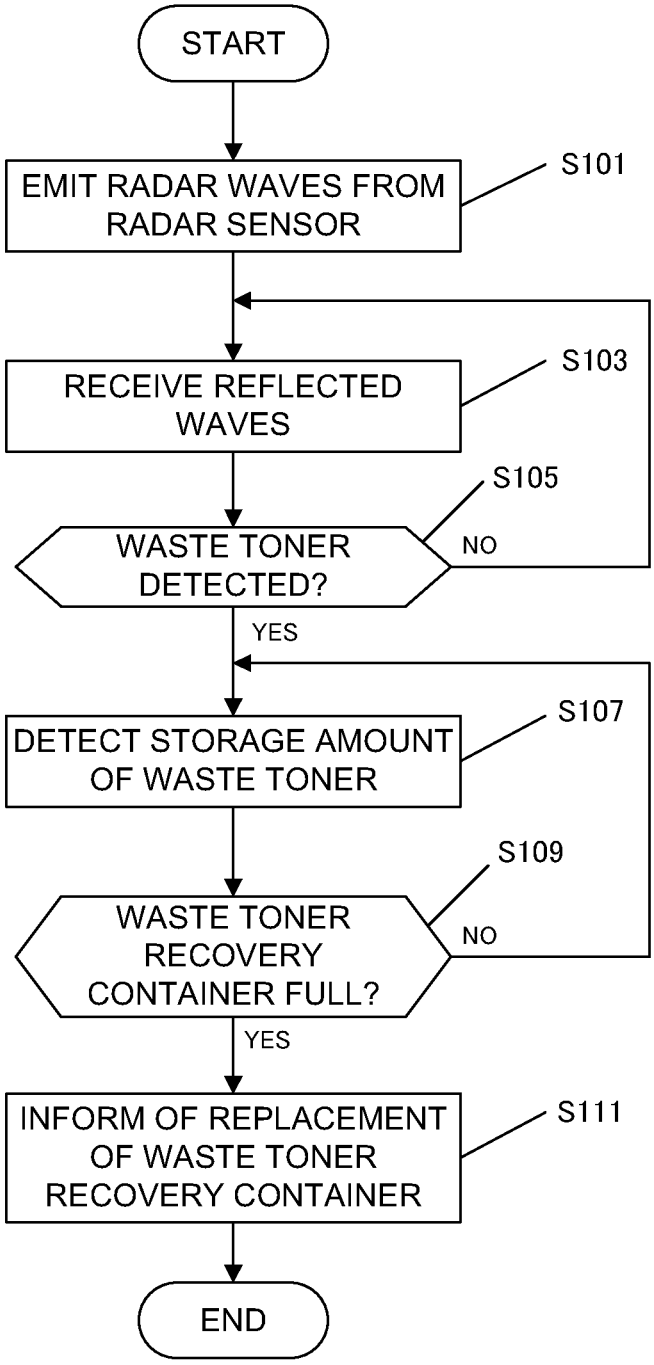
FIG. 6 is a flowchart illustrating an example of a waste toner detection process by the waste toner detection device.

FIG. 6 is a flowchart showing an example of the waste toner detection process by the waste toner detection device according to the first embodiment.

As shown in FIG. 6, in the image forming apparatus 10, when the detection of waste toner in the waste toner recovery container 170 is started, first, a radio wave is emitted from the radar sensor 183 toward the waste toner recovery container 170 (Step S101).

The radar sensor 183 receives the reflected wave (Step S103). Based on the received reflected wave, it is determined whether or not the waste toner 171 recovered in the waste toner recovery container 170 is detected (Step S105).

If it is determined in Step S105 that the waste toner 171 recovered in the waste toner recovery container 170 is detected, the storage amount of the waste toner 171 is detected by the waste toner detector 187 (Step S107). Then, it is determined whether or not the waste toner recovery container 170 is full (Step S109).

When it is determined in Step S109 that the waste toner recovery container 170 is full, it is notified that the waste toner recovery container 170 is to be replaced (Step S111).

If it is determined in Step S109 that the waste toner recovery container 170 is not full, the process returns to Step S107, and the amount of the waste toner 171 to be stored is subsequently detected.

In this way, in the image forming apparatus 10, the waste toner detection device 180 can detect the amount of the waste toner 171 to be stored in the waste toner recovery container 170.

Since the configuration is as described above, according to the first embodiment, the image forming apparatus 10 is provided with the waste toner detection device 180 including the radar sensor 183, the reflector 185, and the waste toner detector 187. Since the radar sensor 183 placed separately from the waste toner recovery container 170 detects the waste toner 171 in the waste toner recovery container 170, the waste toner 171 recovered inside and without touching the waste toner recovery container 170 can be detected. Moreover, it is possible to accurately detect the storage amount of waste toner 171 recovered in the waste toner recovery container 170 with a simple configuration, without occurrence of erroneous detection and disposing of the detection sensor or the like.

In the first embodiment, the residual toner is simply recovered as waste toner in the waste toner recovery container 170, and the recovered waste toner 171 is detected by the radar sensor 183. For example, the recovered waste toner 171 may contain a dielectric additive having reflectance higher than that of the waste toner recovery container 170.

With this configuration, the radar sensor 183 detects the additive together with the waste toner 171, thereby to more accurately detect the amount of the waste toner 171 to be stored.

Second Embodiment

Next, the second embodiment will be described in detail with reference to the drawings.

Figure 7:
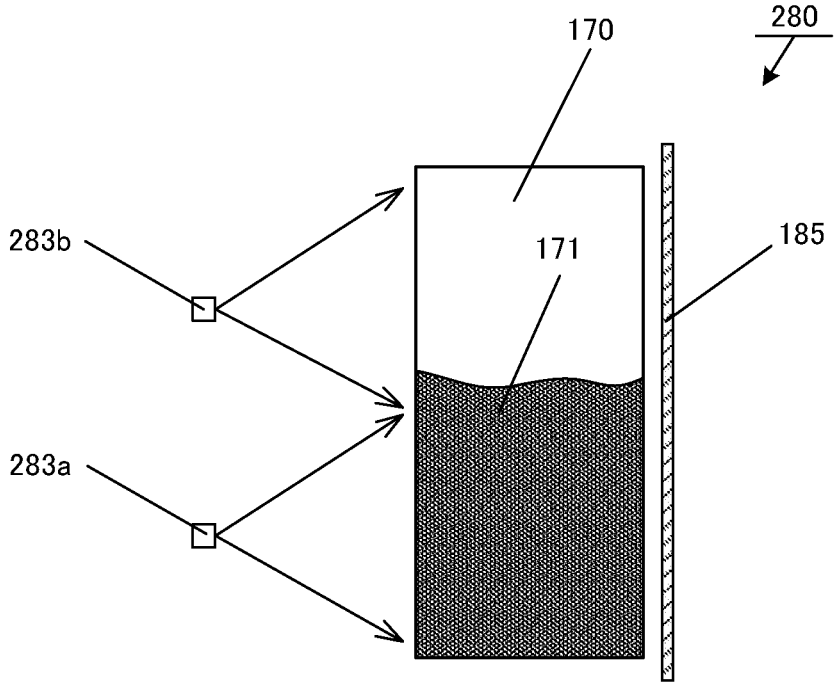
FIG. 7 is an explanatory diagram illustrating an example of a schematic configuration of a waste toner detection device according to the second embodiment.

FIG. 7 is an explanatory diagram showing an example of a schematic configuration of the waste toner detection device according to the second embodiment.

Note that the same reference numerals are assigned into the same configuration of the waste toner detection device according to the second embodiment as that of the waste toner detection device according to the first embodiment, and thus no descriptions will be made thereto again and again.

The second embodiment, as shown in FIG. 7, is characterized in that a waste toner detection device 280 constituting the image forming apparatus detects the waste toner 171 inside the waste toner recovery container 170 by using two radar sensors, a first radar sensor 283*a* and a second radar sensor 283*b*.

The first radar sensor 283*a* and the second radar sensor 283*b* are arranged so as to face the reflector 185 via the waste toner recovery container 170. The first radar sensor 283*a*, the second radar sensor 283*b*, the waste toner recovery container 170, and the reflector 185 are arranged separately from each other.

The first radar sensor 283*a* is arranged at a position facing the lower half side of the waste toner recovery container 170. Further, the first radar sensor 283*a* mainly detects the inside of the lower half of the waste toner recovery container 170.

The second radar sensor 283*b* is arranged at a position facing the upper half side of the waste toner recovery container 170. Further, the second radar sensor 283*b* mainly detects the inside of the upper half of the waste toner recovery container 170.

As described above, according to the second embodiment, the waste toner 171 in the waste toner recovery container 170 is detected by using the two radar sensors of the first radar sensor 283*a* and the second radar sensor 283*b*. Therefore, the first radar sensor 283*a* can detect the state in which the waste toner 171 recovered in the waste toner recovery container 170 is contained up to about half of the inside of the container. Further, the second radar sensor 283*b* can detect a state in which the waste toner 171 recovered in the container 170 is contained in more than half of the container.

As described above, since the storage amount of the waste toner 171 recovered in the waste toner recovery container 170 can be detected by the two radar sensors, it is possible to accurately detect the storage state of the waste toner 171 in the waste toner recovery container 170.

In the second embodiment, the radar sensors are arranged at two locations, the upper and lower locations, but the number and installation locations of the radar sensors are not limited to two. For example, when the waste toner recovery container has a long shape that is elongated in the horizontal direction, a plurality of radar sensors may be arranged in the horizontal direction.

Third Embodiment

Figure 8:
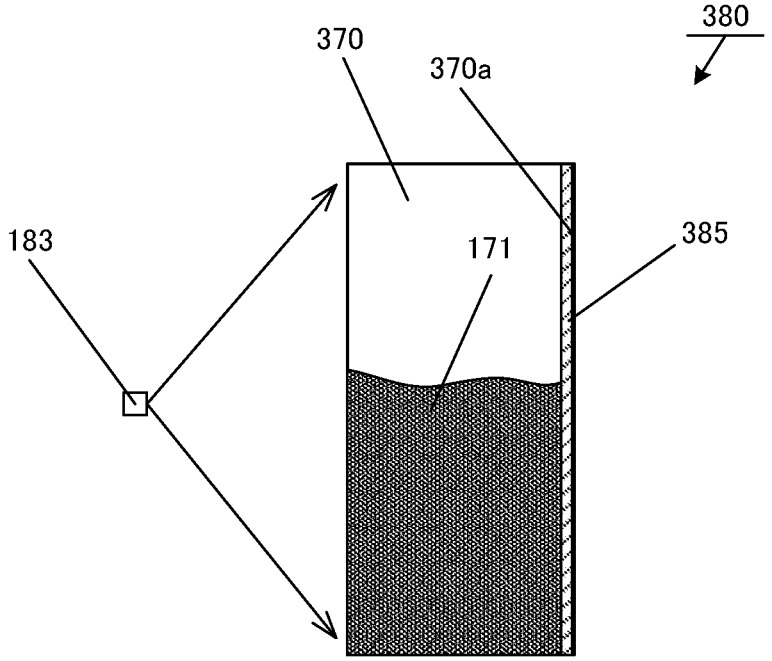
FIG. 8 is an explanatory diagram illustrating an example of a schematic configuration of a waste toner detection device according to the third embodiment.

A third embodiment will now be described. FIG. 8 is an explanatory diagram showing an example of a schematic configuration of the waste toner detection device according to the third embodiment.

Note that the same reference numerals are assigned into the same configuration of the waste toner detection device according to the third embodiment as that of the waste toner detection device according to the first embodiment, and thus no descriptions will be made thereto again and again.

The third embodiment, as shown in FIG. 8, is characterized in that a reflector 385 is provided on an inner wall 370*a* facing the radar sensor 183 in a waste toner detection device 380 constituting the image forming apparatus. This reflector 385 reflects the radio waves from the radar sensor 183 in a waste toner recovery container 370.

The reflector 385 is made of a metal material and is provided along the inner wall 370*a*.

The reflector 385 is formed so that the reflectance thereof becomes higher than the reflectance of the waste toner recovery container 370.

With the above configuration, according to the third embodiment, the reflector 385 is provided on the inner wall 370*a* of the waste toner recovery container 370, so that it is not necessary to provide an additional reflector inside the image forming apparatus main body. Therefore, it is possible to realize a space-saving device configuration without increasing the number of component parts.

In the third embodiment, the metal reflector 385 is provided on the inner wall 370*a* in the waste toner recovery container 370, but the configuration of the reflector 385 is not limited to this.

For example, as the reflector 385, a metal having reflectance higher than that of the waste toner recovery container 370 may be vapor-deposited on the inner wall 370*a* of the waste toner recovery container 370.

Consequently, the present invention is not limited to the above-described embodiments. Various changes are possible within the scope defined by the claims. It is apparent that those skilled in the art can conceive various variations within the scope described in the claims. In other words, the technical scope of the present invention includes embodiments implemented as combinations of technical means modified as appropriate without departing from the spirit of the present invention.

What is claimed is:

1. A stored object detection device comprising:

a container which contains a detection target object;

a radar sensor which emits a radio wave and detects a reflected wave, the radar sensor transmitting the radio wave from outside the container toward an entire surface on the radar sensor side of the container and detecting the reflected wave outside the container;

a reflector which reflects the radio wave emitted from the radar sensor; and a detection target object storage amount detector which detects a storage amount of a detection target object in the container, based on a reflected wave of the radio wave that has been reflected on the container containing the detection target object, a reflected wave of the radio wave that has passed through the container and has been reflected on the detection target object, and a reflected wave of the radio wave that has passed through the container and has been reflected on the reflector.

2. The stored object detection device according to claim 1, wherein the detection target object storage amount detector detects the storage amount of the detection target object in the container, based on reflectance based on the reflected wave that has passed through the container and has been reflected on the detection target object, and reflectance based on the reflected wave that has passed through the container and has been reflected on the reflector.

3. The stored object detection device according to claim 1, wherein the container is formed of a material having reflectance lower than reflectance of the detection target object, and the reflector is formed of a metal material.

4. The stored object detection device according to claim 3, wherein the detection target object includes a dielectric additive having reflectance higher than reflectance of the container.

5. The stored object detection device according to claim 1, wherein the radar sensor is arranged so as to face the reflector through the container, and the radar sensor, the container, and the reflector are separately arranged from each other.

6. The stored object detection device according to claim 1, wherein the radar sensor is arranged so as to face the container, the reflector is provided on an inner wall of the container facing the radar sensor, and the radar sensor and the container are separately arranged from one another.

7. The stored object detection device according to claim 1, wherein the radar sensor includes a plurality of sensors.

8. An image forming apparatus which forms an image by an electrophotographic method using toner, wherein the stored object detection device according to claim 1 is used as a waste toner detection device which detects waste toner in a container containing recovered waste toner.

9. A stored object detection method comprising:

emitting a radio wave from a radar sensor, the radio wave being emitted from outside a container containing a detection target object toward an entire surface on the radar sensor side of the container;

detecting outside the container a reflected wave of the radio wave which has been reflected on the container;

detecting outside the container a reflected wave of the radio wave which has been reflected on the detection target object in the container;

detecting outside the container a reflected wave of the radio wave which has passed through the container and has been reflected on a reflector; and detecting a storage amount of the detection target object in the container, based on a reflected wave which has been reflected on the container, a reflected wave which has been reflected on the detection target object in the container, and a reflected wave which has passed through the container and has been reflected on the reflector.

* * * * *